US010639690B2

(12) United States Patent
Jungen et al.

(10) Patent No.: US 10,639,690 B2
(45) Date of Patent: May 5, 2020

(54) PREPARING A TUBE END FOR ROD DRAWING

(71) Applicant: SMS GROUP GmbH, Duesseldorf (DE)

(72) Inventors: Hardy Jungen, Moenchengladback (DE); Thomas Winterfeldt, Willich (DE)

(73) Assignee: SMS GROUP GMBH, Duesseldorf (DE)

( * ) Notice: Subject to any disclaimer, the term of this patent is extended or adjusted under 35 U.S.C. 154(b) by 474 days.

(21) Appl. No.: 15/437,495

(22) Filed: Feb. 21, 2017

(65) Prior Publication Data

US 2018/0021826 A1 Jan. 25, 2018

(30) Foreign Application Priority Data

Jul. 22, 2016 (DE) ..... 10 2016 213 480

(51) Int. Cl.

| | |
|---|---|
| ***B21C 1/24*** | (2006.01) |
| ***B21C 1/32*** | (2006.01) |
| ***B21C 5/00*** | (2006.01) |
| ***B21C 3/16*** | (2006.01) |

(52) U.S. Cl.

CPC ..... *B21C 1/24* (2013.01); *B21C 1/32* (2013.01); *B21C 3/16* (2013.01); *B21C 5/003* (2013.01)

(58) Field of Classification Search

CPC ..... B21B 25/00; B21B 25/02; B21B 25/04; B21C 1/24; B21C 1/32; B21C 1/34; B21C 3/16; B21C 5/003; B21D 39/20; B21D 41/02; B21D 41/026; B21D 41/028

See application file for complete search history.

(56) References Cited

U.S. PATENT DOCUMENTS

| | | | | |
|---|---|---|---|---|
| 198,254 A | | 12/1877 | Skinner | |
| 1,791,887 A | * | 2/1931 | Davies | B21D 41/025 72/318 |
| 2,016,795 A | * | 10/1935 | Belknap | B21D 41/025 72/318 |
| 2,728,373 A | * | 12/1955 | Zimpel | B21D 41/02 72/316 |
| 3,572,080 A | * | 3/1971 | Alexoff | B21C 5/00 72/273.5 |
| 3,587,287 A | | 6/1971 | Vacca | |
| 4,655,065 A | | 4/1987 | Sansome et al. | |
| 4,779,441 A | * | 10/1988 | Pringle | B21D 41/021 72/316 |
| 4,843,860 A | * | 7/1989 | Gray | B21D 41/02 72/318 |

(Continued)

FOREIGN PATENT DOCUMENTS

| | | |
|---|---|---|
| DE | 2758137 B1 | 4/1979 |
| DE | 19756293 A1 | 6/1999 |

*Primary Examiner* — Edward T Tolan

(74) *Attorney, Agent, or Firm* — Andrew Wilford

(57) ABSTRACT

An apparatus for preparing a tube end for rod drawing with a floating mandrel has a releasable holder for the tube end centered on an axis, a frustoconical and spreadable floating mandrel, and a device for inserting the mandrel into the tube end and spreading the mandrel to flare the tube end. The apparatus further has a feed mechanism for inserting the floating mandrel into the tube end and/or a deforming device for making at least one indentation in the tube for holding the floating mandrel.

12 Claims, 4 Drawing Sheets

(56) References Cited

U.S. PATENT DOCUMENTS

| | | | | |
|---|---|---|---|---|
| 4,856,703 | A * | 8/1989 | Uhlmann | B21C 1/24 228/156 |
| 9,555,464 | B2 * | 1/2017 | Samko | B21D 53/02 |
| 9,656,355 | B2 * | 5/2017 | Tokura | B21D 41/028 |
| 2012/0198901 | A1 * | 8/2012 | Yamamoto | B21C 1/24 72/43 |

* cited by examiner

PREPARING A TUBE END FOR ROD DRAWING

FIELD OF THE INVENTION

The present invention relates to a method of and apparatus for preparing a tube end for rod drawing.

BACKGROUND OF THE INVENTION

In order to reshape tubes by rod drawing, one end of a tube must be prepared appropriately for attachment to drawing tongs. During rod drawing with a slide or floating mandrel, this mandrel must also be fitted with precision into the end of the tube. Such preparatory measures are usually done manually to a large extent and carried out with no or little automation.

Solutions are known from the practice of rod drawing whereby the slide mandrel is first introduced by a machine into the tube, after which indentations are formed in the tube casing simultaneously behind and in front of the inserted mandrel. Before insertion of the mandrel, strict requirements must be met with regard to the perpendicular alignment of the tube end, which must often be done manually.

The use of an apparatus according to the invention preferably, but not necessarily, relates to tubes made of a relatively soft metal such as copper, for example. The use of a slide mandrel in the tube and a die outside reduces the tube's wall thickness while imparting to it an exact inside and outside diameter.

OBJECTS OF THE INVENTION

It is therefore an object of the present invention to provide an improved preparing a tube end for rod drawing.

Another object is the provision of such an improved preparing a tube end for rod drawing that overcomes the above-given disadvantages, in particular that enables easy and reliable positioning of the slide mandrel in the tube end.

SUMMARY OF THE INVENTION

An apparatus for preparing a tube end for rod drawing with a floating mandrel has according to the invention a releasable holder for the tube end centered on an axis, a frustoconical spreading mandrel, and means for inserting the spreading mandrel into the tube end and spreading the spreading mandrel to flare the tube end.

The automated widening with the spreading mandrel makes it possible to introduce the floating mandrel easily and reliably into the tube end.

In a preferred development, the apparatus comprises a feed mechanism for inserting the floating mandrel into the tube end and/or a deforming device for making at least one indentation in the tube for holding the floating mandrel.

In an advantageous development, the tube end can first be widened in an automated manner by the frustoconical spreading mandrel before the feed mechanism introduces the floating mandrel into the tube end.

A spreading mandrel can be a mandrel that tapers at a suitable sharp apex angle. In terms of the invention, an automated process is preferably understood as meaning that no manual interventions are made on the tube end between the steps of the automated process.

A deforming device is preferably understood in terms of the invention as being tongs or a plurality of tongs that locally exert force for radially forming aligned indentations in the tube. The indentations narrow the tube cross section locally so that they limit the free movement of the rod or mandrel particularly until start of the drawing process. In the context of a subsequent drawing process, the forces of drawing tongs and a drawing die are then so great that the floating mandrel is pressed past the indentation.

The releasable holder for the centered supporting of the tube end can be embodied in a variety of ways according to the invention. In a first possibility, it can be an apparatus that is separate from the deforming device. Such a holder can be particularly arranged so as to be spaced apart from the deforming device. The holder and the deforming device can be preferably movable relative to each other. Especially preferably, the deforming device can be moved toward the held tube end, or the tube end received in the holder can be fed to the deforming device.

In a detailed embodiment of the invention that represents an alternative to this, the holder can be embodied with the deforming device as an integral unit. For instance, at least one pressing pin of the deforming device can be one of several supports for holding the tube end. Depending on requirements, the pressing pin can be an element that can be moved separately relative to the rest of the holder. This enables deformation-free holding of the tube end to be achieved initially, in order to then create one (or more) indentations by actuation of the at least one pressing pin. In one especially simple construction, the pressing pin can also be provided as a solid projection in the region of an appropriately strong holder, for example one that can be closed like a pair of jaws. In such a solution, the steps of holding and of the forming of an indentation are carried out simultaneously.

In a preferred development of the invention, the spreading mandrel has an injector for introducing drawing oil into the tube. As a result, the widening and the lubricating that is required before introduction of the slide mandrel are grouped together. The injector can be embodied particularly as a separately displaceable line in a central hole or passage of the spreading mandrel.

In an especially preferred embodiment of the invention, the deforming device can make a first indentation positioned in front of the mandrel and a second indentation positioned behind the mandrel separately from one another. Especially preferably, the tube can be held by the first indentation in a form-fitting manner against axial movement of the tube when the spreading mandrel widens the tube end. As a result, the high axial forces during widening are effectively absorbed. The slide mandrel can then be introduced without any difficulty, since the second indentation does not exist to start with.

In one structurally simple embodiment, the deforming device has at least two pressing pins that are spaced apart from one another in the tube axial direction and can be pressed against the tube end independently of one another. In alternative solutions, however, a deforming device that can be displaced relative to the tube can also be provided, so that the first and the second indentation can be formed by the same pressing pin.

Forming of two indentations for the positive limitation of the floating mandrel is advantageous but not necessary in terms of the invention. It is also possible for only one or only the first indentation to be provided. In that case, the mandrel is preferably prevented from falling out of the tube end by appropriate frictional forces.

In a generally advantageous development of the invention, the apparatus comprises a pointing press that imparts a pointed shape to the tube end for drawing tongs after introduction of the floating mandrel. This enables the integrated, complete preparation of the tube end before introduction into a drawing apparatus. Preferably, the pointing is also done in an automated manner, so that no manual interventions need to be made on the tube from the centered supporting of the tube through the widening and the introduction of the floating mandrel as well as the pointing of the tube end.

What is more, the apparatus according to the invention advantageously makes it possible for the tube end to have a nonsquare undefined, cut edge, in which case the spreading mandrel engages in the tube end without any correction of the cut edge. For example, tubes can have angles from cut edges of greater than 30° with respect to a tube axis and be prepared reliably and automatically using the apparatus according to the invention nonetheless.

The object is also achieved by a method for preparing a tube end for rod drawing that comprising the steps:

a) centered supporting of the tube end in a holder;
b) forming at least one first indentation by a deforming device;
c) widening the tube end by a frustoconical spreading mandrel while the tube end is held against axial movement of the tube by the deforming device and the first indentation; and
d) introduction of a floating mandrel into the tube end until immediately in front of the first indentation.

It is generally preferred for at least steps c) and d) to be carried out together in an automated manner without manual interaction. It is also preferred for at least steps b), c), and d) to be carried out together in an automated manner without manual interaction.

It is especially preferred for all of the steps of a method according to the invention to be carried out together in an automated manner without manual interaction. If at all, the initial feeding of the tube end to the holder can done manually. Depending on the degree of automation of the overall system for tube-drawing, however, this task can also be performed in an automated manner.

In a preferred embodiment, the method further comprises the step of forming a second indentation by a deforming device, with the floating mandrel being caught between the two indentations.

As a result, the mandrel is fixed in both directions in a positive and especially secure manner in the tube end.

Especially preferably, the method is carried out by an apparatus according to the invention.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
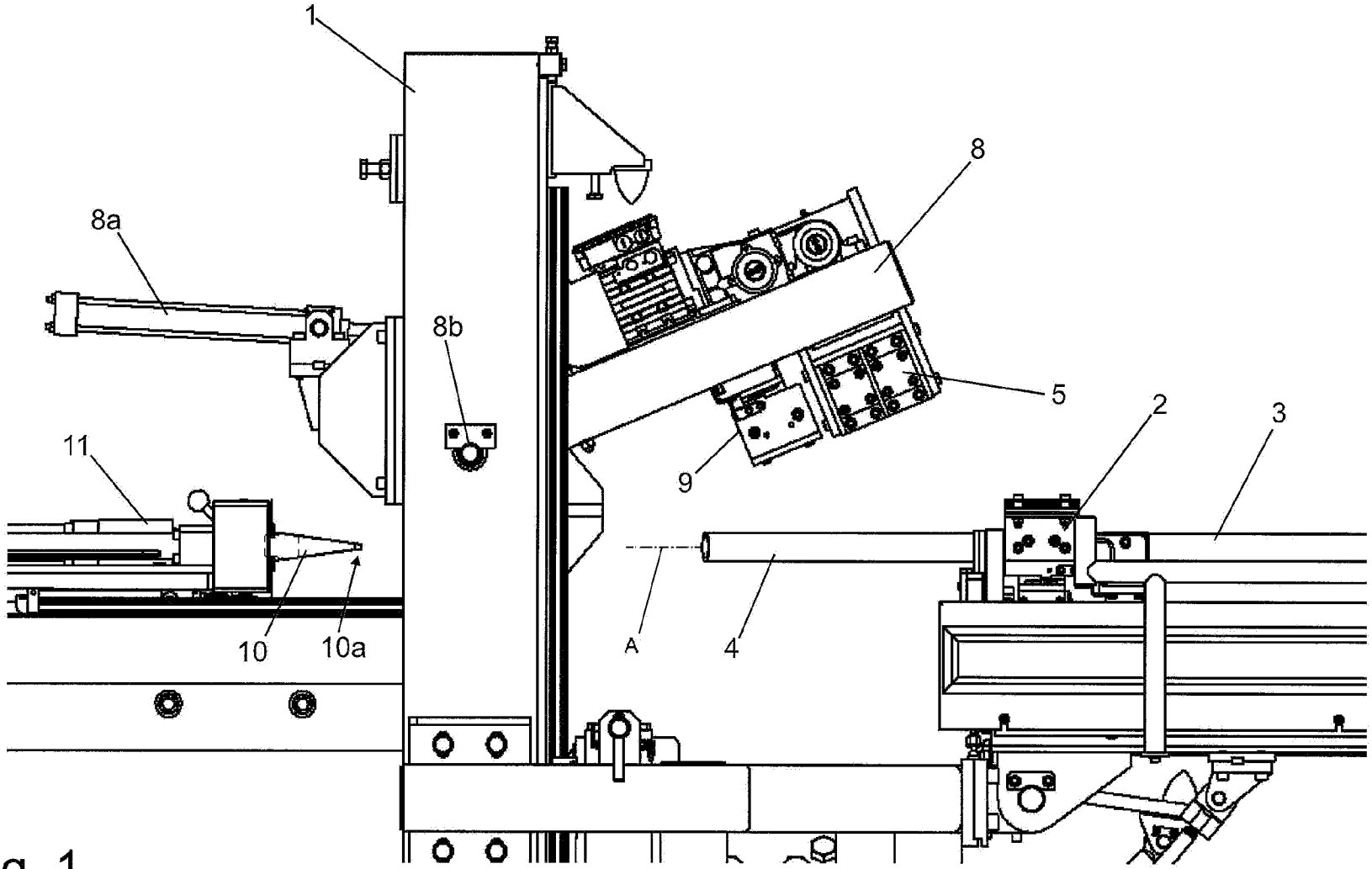
FIG. 1 is a side view of a part of an apparatus according to the invention.

As seen in FIG. 1 the apparatus of this invention has a frame 1 on which several displaceable elements are incorporated. A releasable holder 2 for receiving a tube 3 on the frame 1 has a gripper 2*a* that holds a tube 3 without marring or damaging it. The tube 3 is preferably made of a soft metal such as copper. It has one end 4 with a cut edge 4*a* that is largely undefined in terms of angle and orientation. Along most of its length the tube 3 is held in a drum (not shown) that supplies it to a drawing station after formation of the tube end 4 according to the invention. Alternatively, the apparatus according to the invention can also be movable as a whole and moved to a respective tube for forming the tube end 4.

After the tube end 4 is gripped in the holder 2 so the tube is centered on a normally horizontal axis A, a deforming device 5 engages over the tube end 4. The deforming device 5 comprises two spaced pressing pins 6 and 7 controlled by respective hydraulic cylinders 6*a* and 7*a*. Here, the pressing pins 6 and 7 are each formed by at least two opposing or mutually counteracting pairs of pins. Alternative arrangements with only one single pressing pin 6 and 7 and a corresponding abutment are also possible.

The deforming device 5 is carried on an arm 8 that can be pivoted by an actuator 8*a* about an axis 8*b* toward and away from the tube end 4. In addition to the deforming device 5, a clamp 9 with a clamps 9*a* for the tube end 4 is carried on the pivot arm 8.

Figure 2:
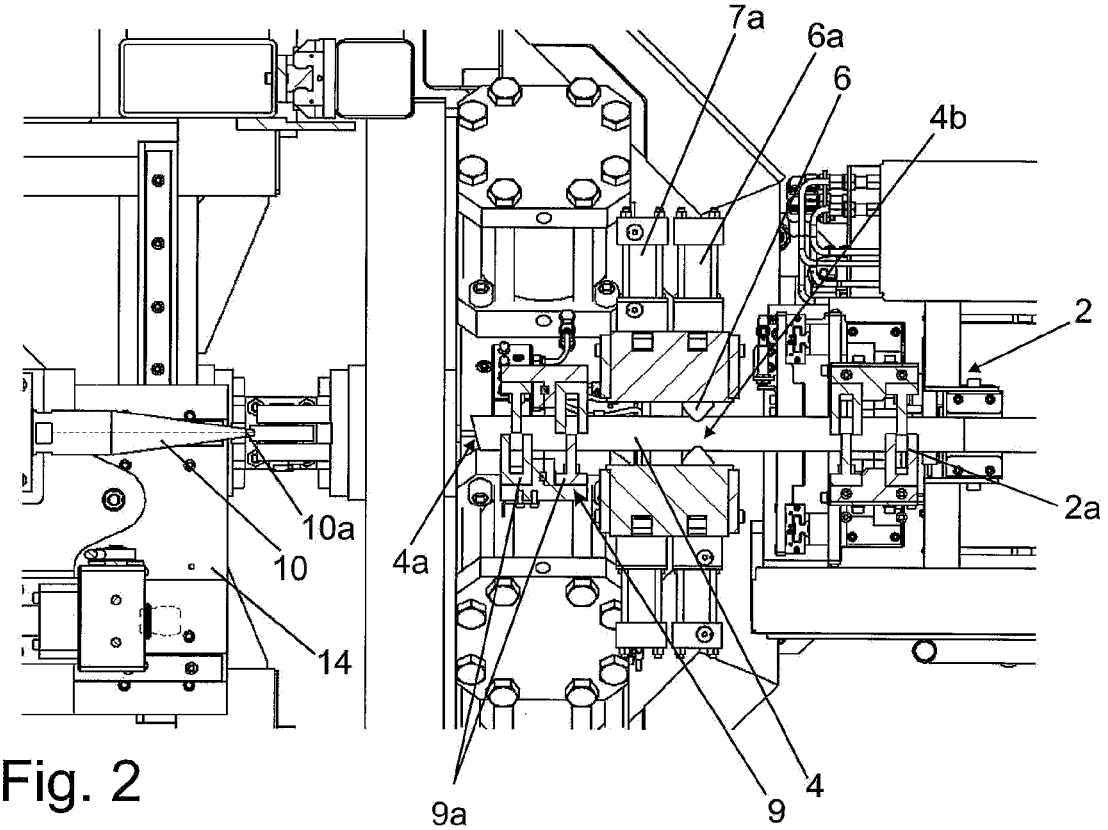
FIG. 2 is a top view in enlarged scale of a detail of the apparatus of FIG. 1 after a first tube process step.

A spreading mandrel 10 with a frustoconical outer surface is carried on a mandrel support 11 that can be displaced on the frame 1. The mandrel support 11 can be moved automatically along the frame 1 axially of the tube 3 held in the holder 2 in order to insert the spreading mandrel 10 into the tube end 4 (see FIG. 2). The spreading mandrel 10 can then be driven forward automatically axially of the tube, which is horizontally in the present case. The spreading mandrel enters the tube end 4 and flares it (see FIG. 3).

Figure 3:
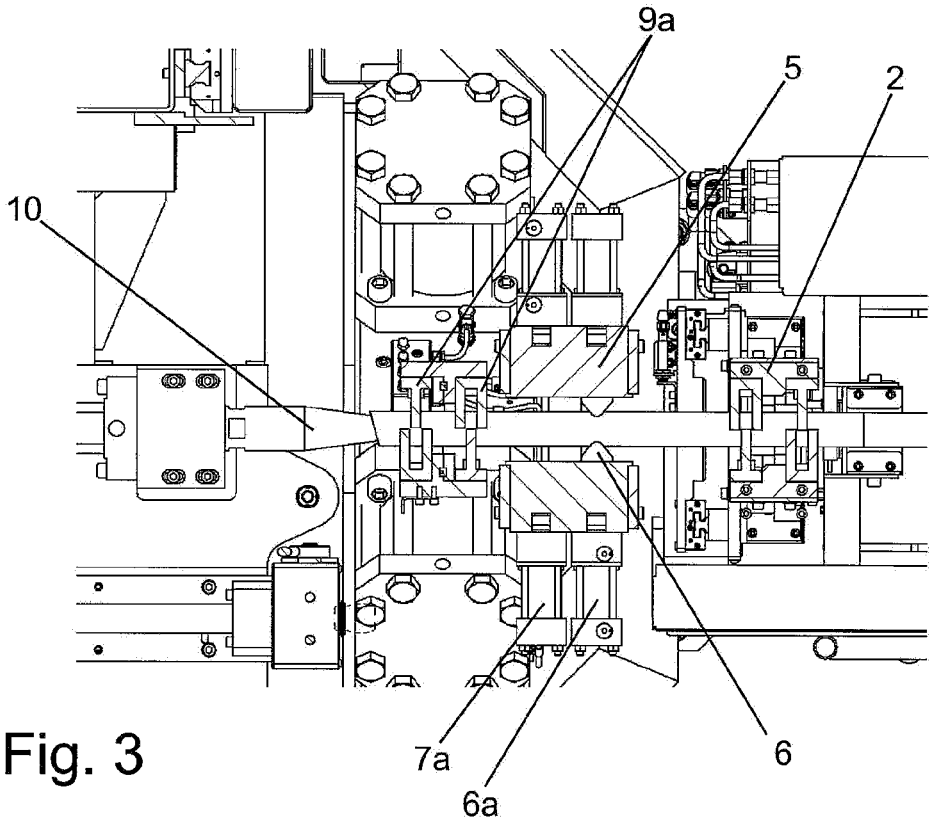
FIG. 3 is a large-scale view of a detail of FIG. 2 during a second process step.
Figure 4:
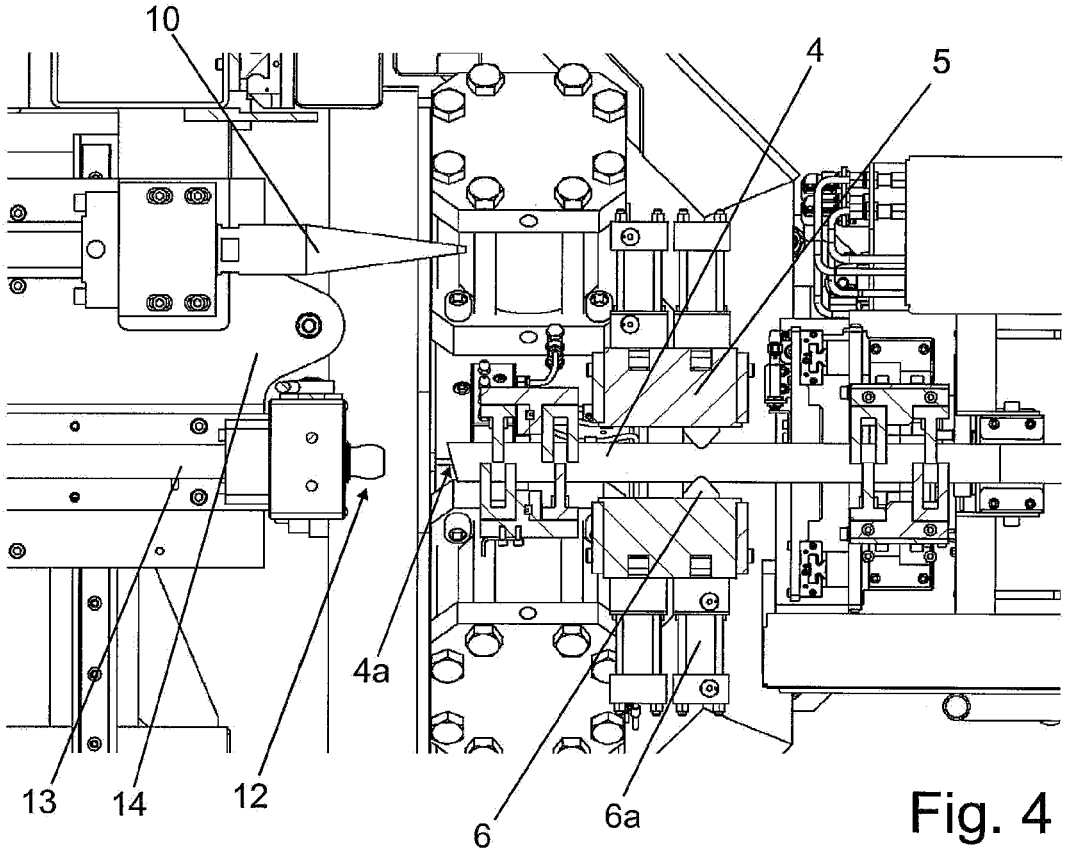
FIG. 4 is a view like FIG. 3 showing the apparatus 2 before the introduction of a floating mandrel into the tube.

As indicated in FIGS. 3 and 4, the cut edge 4*a* of the tube end 4 has an undefined angle, in which case sufficient guidance and widening is ensured nonetheless by the small apex angle of the spreading mandrel 10.

In order to achieve good holding and supporting of the tube 3 in the tube axial direction during widening, a first indentation 4*b* is formed in the tube 3 by the first pressing pin 6 before the spreading mandrel widens the end. The pressing pin 6 remains initially in the inserted position in the indentation 4*b* so that the tube 4 is solidly gripped and cannot move axially (see position of the pressing pins 6 and 7 in FIG. 2). The forces of the spreading mandrel 10 acting in the tube axial direction are thus transmitted to the frame 1 mainly by the first pressing pin 6 or the deforming device 5 via the pivot arm 8. Movement of the tube 3 during widening is effectively prevented. At this time, no indentation is yet made in the tube end 4 by the second pressing pin 7.

In addition, the spreading mandrel 10 has a central passage 10*a* that acts as part of an injector for supplying drawing oil into the interior of the tube 3 in its end region. The drawing oil is expediently injected during widening, so that the friction of the spreading mandrel 10 can also be reduced. The drawing oil facilitates sliding of a floating mandrel 12 introduced into the tube end 4 after widening.

The floating mandrel 12 is releasably mounted on a lance-shaped feed mechanism 13. The feed mechanism 13 is held laterally adjacent the spreading mandrel 10 on a support 14 that can be displaced transverse to the tube axis A on the frame 1. The support 14 receives both the mandrel support 11 of the spreading mandrel 10 and the feed mechanism 13 of the floating mandrel 12.

After the radial widening or flaring process described above, the spreading mandrel 10 is retracted and the support 14 moves into a position in which the floating mandrel 12 is aligned along the axis A with the now widened tube end 4. The mandrel 12 is now introduced by the feed mechanism 13 into the tube end 4 (see FIG. 5). The mandrel 12 ultimately comes to rest behind the first indentation 4*b*.

Figure 6:
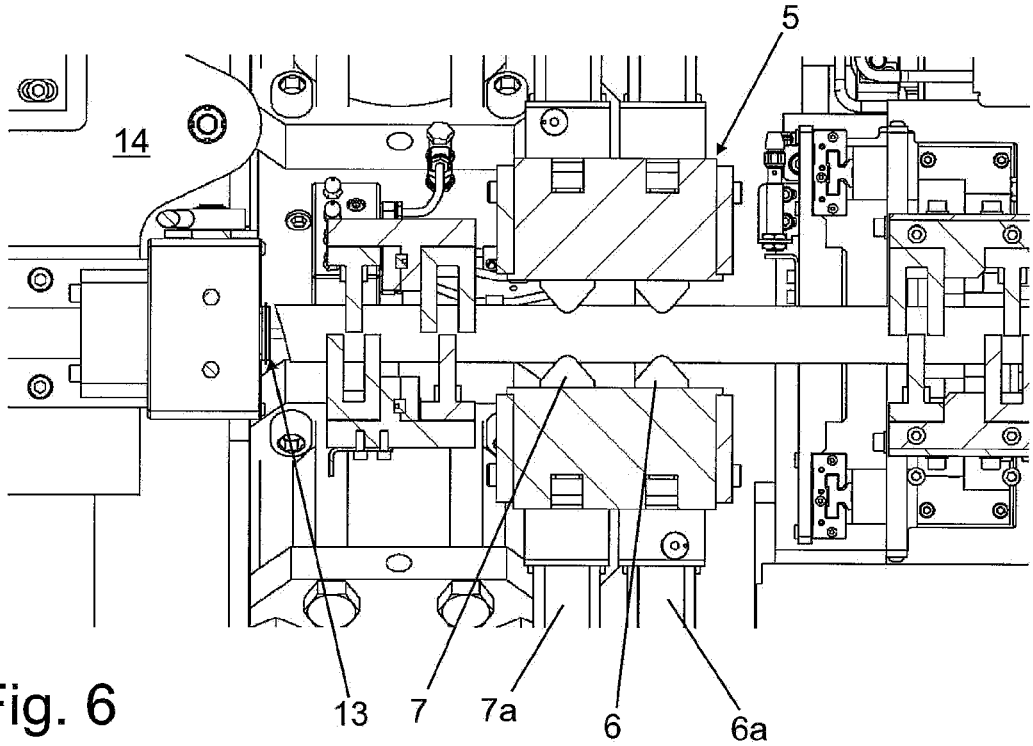
FIG. 6 is yet another view like FIG. 2 after an additional tube process step.

A second indentation 4*c* is then formed in the tube 3 by the second pressing pin 7, so that a head of the floating mandrel 12 is caught between the first indentation 4*a* positioned in front of the head of the mandrel 12 and the second indentation 4*b* positioned behind it (see FIG. 6). The feed mechanism 13 is now released from the mandrel 12 and retracted.

A pointing press 15, which is also held in a movable manner on the frame 1, then moves into position and presses the end of the tube 3 to a reduced diameter. This process is also referred to as the pointing of the tube end 4.

The tube end 4 prepared in this manner can be grasped in the pointed region using unillustrated drawing tongs and pulled through a die. The floating mandrel 12 is carried along in a known manner.

It will readily be understood that the entire process described above takes place continuously and automatically, particularly in a computer-controlled manner, from the initial supporting of the tube end 4 through the conclusion of the pointing.

Figure 5:
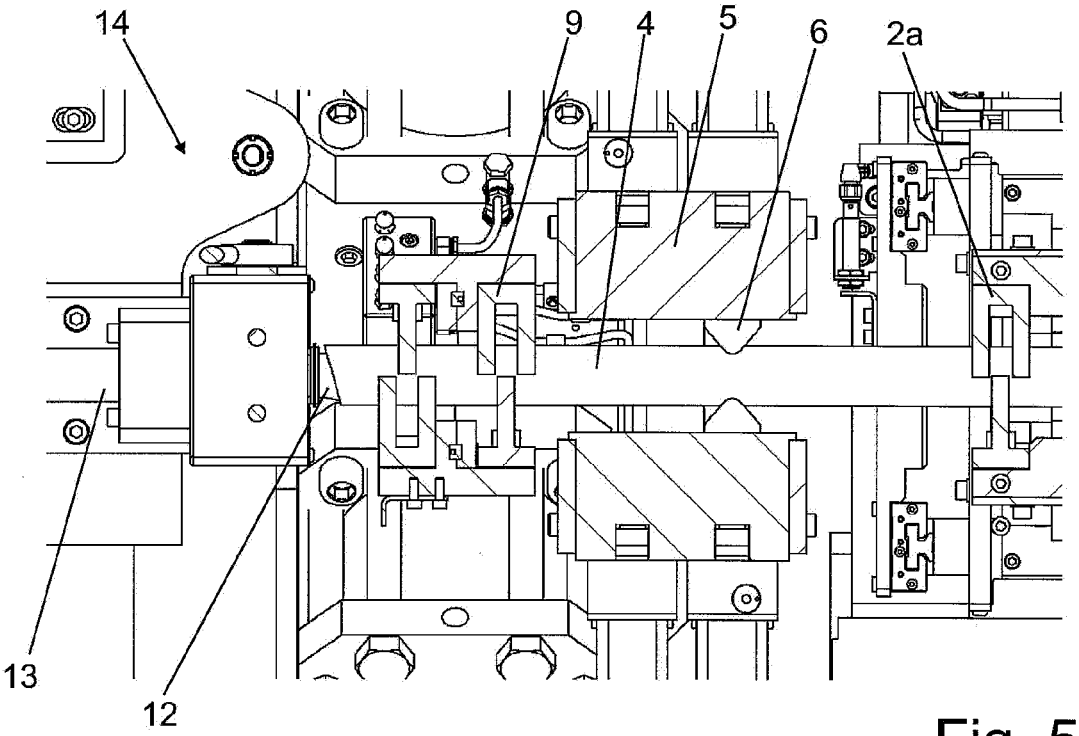
FIG. 5 is another view like FIG. 3 after introduction of the mandrel.
Figure 7:
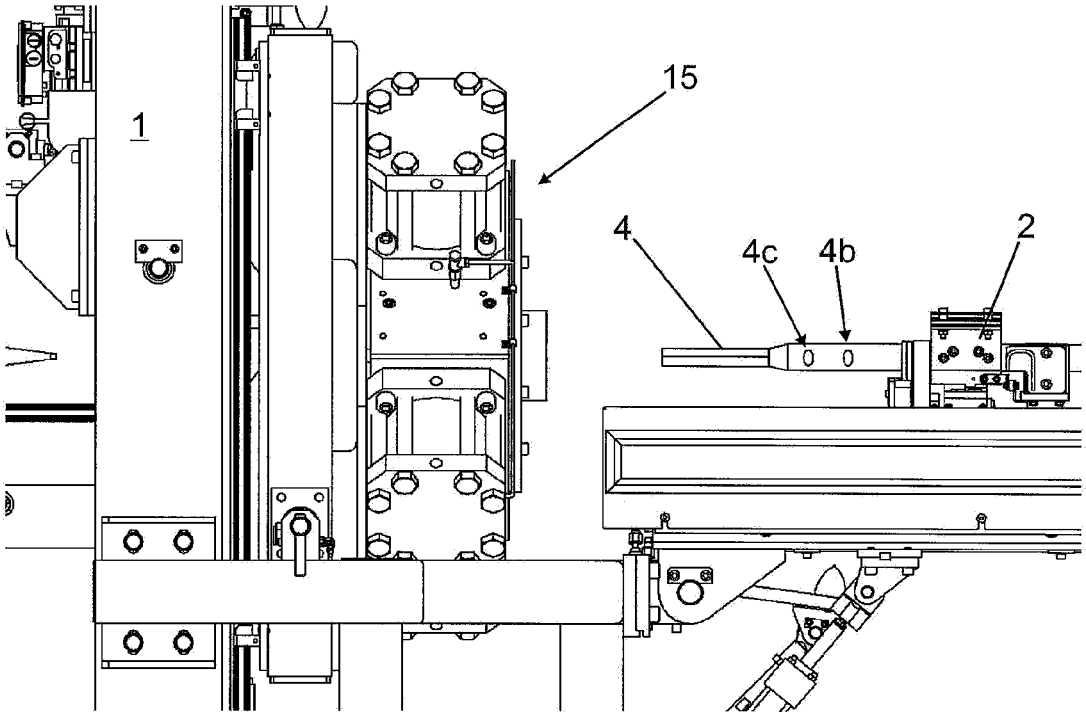
FIG. 7 is another detail view of the apparatus in side view as in FIG. 1 after pointing of the tube.

Analogously with the individual stations and procedures described above, a method for preparing the tube end 4 comprises the following automatically proceeding steps:

a) centered supporting of the tube end 4 in the holder 2 (see FIG. 1);

b) forming the first indentation 4*b* by the deforming device 5, 6 (see FIG. 2) 1 c) widening the tube end 4 by the tapered spreading mandrel 10, with the tube end 4 being held axially of the tube by the deforming device 5, 6 and the first indentation 4*b* (see FIG. 3);

d) introduction of the floating mandrel 12 into the tube end 4 until immediately behind the first indentation 4*b* (see FIG. 5);

e) forming the second indentation 4*c* by the deforming device 5, 7, with the floating mandrel 12 between the two indentations 4*b*, 4*c* (see FIG. 6); and f) pointing the tube end 4 by the pointing press 15 (see FIG. 7).

In the example described above, the holder 2 and the deforming device 5 are separate units arranged so as to be spaced from one another. In unillustrated alternative embodiments of the invention, the holder and the deforming device can also be an integral unit. Depending on the details of the design, the deforming device can have one or more separately actuatable pressing pins in a manner similar to the described example. In an especially simple design, at least one of the pressing pins can be embodied as a fixed projection in the holder, so that closing the holder simultaneously forms an indentation in the tube end. In this case, the steps of the supporting of the tube end and of the formation of an indentation are not carried out automatically in a successive manner, but rather automatically in a simultaneous manner.

We claim:

1. An apparatus for preparing a tube end for rod drawing, the apparatus comprising:

a floating mandrel;

a releasable holder for the tube end centered on an axis;

a frustoconical spreading mandrel;

means for inserting the spreading mandrel into the tube end and spreading the spreading mandrel to flare the tube end; and means for inserting the floating mandrel into the flared end of the tube after insertion into and removal of the spreading mandrel from the tube.

2. The apparatus defined in claim 1, further comprising:

a deforming device for forming a first indentation in the tube for gripping the floating mandrel.

3. The apparatus defined in claim 1, wherein the spreading mandrel has an injector for introducing drawing oil into the tube.

4. The apparatus defined in claim 2, wherein the deforming device forms the first indentation axially in front of the floating mandrel and a second indentation axially behind the floating mandrel and spaced from the floating mandrel.

5. The apparatus defined in claim 4, wherein the floating mandrel has a head axially captured in the tube between the indentations.

6. The apparatus defined in claim 4, wherein the tube can be held by the first indentation in a form-fitting manner axially of the tube when the spreading mandrel widens the tube end.

7. The apparatus defined in claim 2, wherein the deforming device has at least two pressing pins spaced axially from one another and pressable independently of one another against the tube end.

8. The apparatus defined in claim 1, further comprising:

a pointing press for imparting a pointed shape to the tube end for drawing tongs after introduction of the floating mandrel.

9. A method for preparing a tube end for rod drawing, the method comprising the steps of:

a) holding the tube centered on an axis;

b) forming a first indentation in the held tube end with a deforming device;

c) widening the tube end of the held tube with a frustoconical spreading mandrel while holding the tube end against axial movement by engagement of the deforming device in the first indentation; and d) introduction a floating mandrel by a feed mechanism into the tube end until before the first indentation.

10. The method defined in claim 9, wherein the tube end is widened by the frustoconical spreading mandrel before the feed mechanism introduces the floating mandrel into the tube end.

11. The method defined in claim 9, wherein the tube end has a non-rectangular undefined cut edge, and the spreading mandrel is engaged in the tube end without any correction of the cut edge.

12. The method defined in claim 9, further comprising the step of:

forming a second indentation by the deforming device, with the floating mandrel being caught between the first and second indentations.

* * * * *